United States Patent [19]

Sanno

[11] Patent Number: 4,747,482

[45] Date of Patent: May 31, 1988

[54] BOBBIN CONVEYING APPARATUS

[75] Inventor: Hiroaki Sanno, Nonoichi, Japan

[73] Assignee: Murao Boki Kabushiki Kaisha, Kanazawa, Japan

[21] Appl. No.: 804,613

[22] Filed: Dec. 5, 1985

[51] Int. Cl.[4] ..... B65G 47/22

[52] U.S. Cl. ..... 198/803.01; 198/416; 198/803.12; 198/468.8; 242/35.5 A; 242/46

[58] Field of Search ..... 242/35.5 A, 41, 46; 198/343, 463.3, 465.1, 468.6, 803.01, 465.2, 468.8, 803.12, 835–837, 841, 860.1, 860.3, 409, 384, 411–413, 416, 597, 598

[56] References Cited

U.S. PATENT DOCUMENTS 3,666,082 5/1972 Riggs ..... 198/835
3,874,497 4/1975 Carlson ..... 198/836
4,613,091 9/1986 Kiriake ..... 242/35.5 A

FOREIGN PATENT DOCUMENTS 3544561 7/1986 Fed. Rep. of Germany ..... 198/409

*Primary Examiner*—Robert J. Spar
*Assistant Examiner*—Lyle K. Kimms
*Attorney, Agent, or Firm*—Oblon, Fisher, Spivak, McClelland & Maier

[57] ABSTRACT

A bobbin conveying apparatus comprising a plurality of trays each of which has a bobbin supporting pin insertable in the bobbin; a pair of guide rails assembled in loops for guiding the trays; a round belt running along the guide rails, the belt being kept with the bottom surfaces of the trays so that the trays are frictionally moved in accordance with the movement of the belt; a mechanism for stopping the bobbin so that the belt continues to run away from the arrested bobbin; and a bobbin take-up means for taking up the arrested bobbin from the tray.

5 Claims, 5 Drawing Sheets

BOBBIN CONVEYING APPARATUS

BACKGROUND OF THE INVENTION

1. Field of the Invention

The present invention relates to a bobbin conveying apparatus, and more particularly, a bobbin conveying apparatus including a bobbin take-up device for facilitating the operation taking place in the subsequent line.

2. Description of the Prior Art

In the yarn spinning factories it is essential to convey intermediate products, such as bobbin-wound or cheese-wound yarn, from one line to another. In a most primitive form the bobbins are conveyed on carts. This is time- and labor-consuming, and additionally the yarn is in danger of stain and tangle. To improve such labor-consuming methods an automatic conveyor has been devised, and is widely used. On the known conveyors the bobbins are placed directly on the conveyor belt, which is driven by an electric motor. The disadvantage of this method is that the bobbins tend to slip off the belt because of vibration. This necessitates the provision of a device for preventing the bobbins from falling off the belt. For example, preventive edges are provided at both sides of the belt, or bobbin insertion pins are erected on the belt.

When the bobbin insertion pins are used, a difficulty is involved in taking up the bobbins from them. In addition, the conveyor is generally made of a flat belt, which makes it difficult to form a bent or curved bobbin feeding path. As a result, the conveyor is horizontal and straight. When a bent bobbin feeding path is to be built, several units of straight conveyors are jointed to one another so as to provide a single bent feeding path. Another disadvantage of the known pinned conveyor belt is that the bobbins are always taken up at the constant intervals at which the pins are planted on the conveyor belt. However, it sometime happens that they must be taken up at desired intervals so as to meet the operational speed of the subsequent line. Under the known conveyor system it is impossible to stop a selected bobbin from conveyor or adjust the conveying speed.

SUMMARY OF THE INVENTION

The present invention aims at solving the problems pointed out above, and has for its object to provide an improved bobbin conveying apparatus which ensures that the bobbins are taken up at desired intervals irrespective of the intervals of conveyance.

Another object of the present invention is to provide an improved bobbin conveying apparatus, which is capable of free assemblage, such as a straight form, a bent form or an up-and-down form.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided a bobbin conveying apparatus, which comprises:

a plurality of trays each of which has a bobbin supporting pin insertable in the bobbin;

a pair of guide rails assembled in loops for guiding the trays;

a round belt running along the guide rails, the belt being kept with the bottom surfaces of the trays so that the trays are frictionally moved in accordance with the movement of the belt;

means for stopping the bobbin so that the belt continues to run away from the arrested bobbin; and a bobbin take-up means for taking up the arrested bottin from the tray.

DETAILED DESCRIPTION OF THE PREFERRED EMBODIMENT

Figure 1:
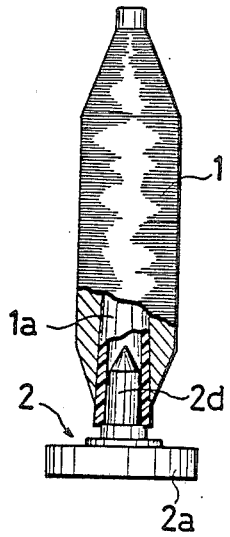
FIG. 1 is a partially cross-sectional view showing a tray and a yarn-wound bobbin placed thereon.

The reference numeral 1 denotes a bobbin around which a yarn is wound, hereinafter referred to as the bobbin, wherein the yarn-free bobbin as a winder will be referred to as the bobbin body 1*a*. A number of bobbins 1 are individually placed on trays 2, which includes a seat 2*a* having a larger diameter than the outside diameter of the bobbin 1 as best shown in FIG. 1, a boss 2*b* in the center of the seat, and a collar 2*c* provided coaxially of the seat, on which the bobbin 1 rests. The outside diameter of the collar 2*c* is smaller than the outside diameter of the bobbin body 1*a*. The collar 2*c* is provided with a pin 2*d*, which is inserted into the bottom of the bobbin body 1*a*. The tray 2 is usually made in one piece with plastic, but as described below, the collar 2*c* and the pin 2*d* can be separately made from the seat 2*a* and the boss 2*b*, and each of them can be rotatively fixed with respect to the seat and the boss. The top end of the pin 2*d* is sharpened so as to facilitate the insertion thereof into the bobbin bottom.

Figure 2:
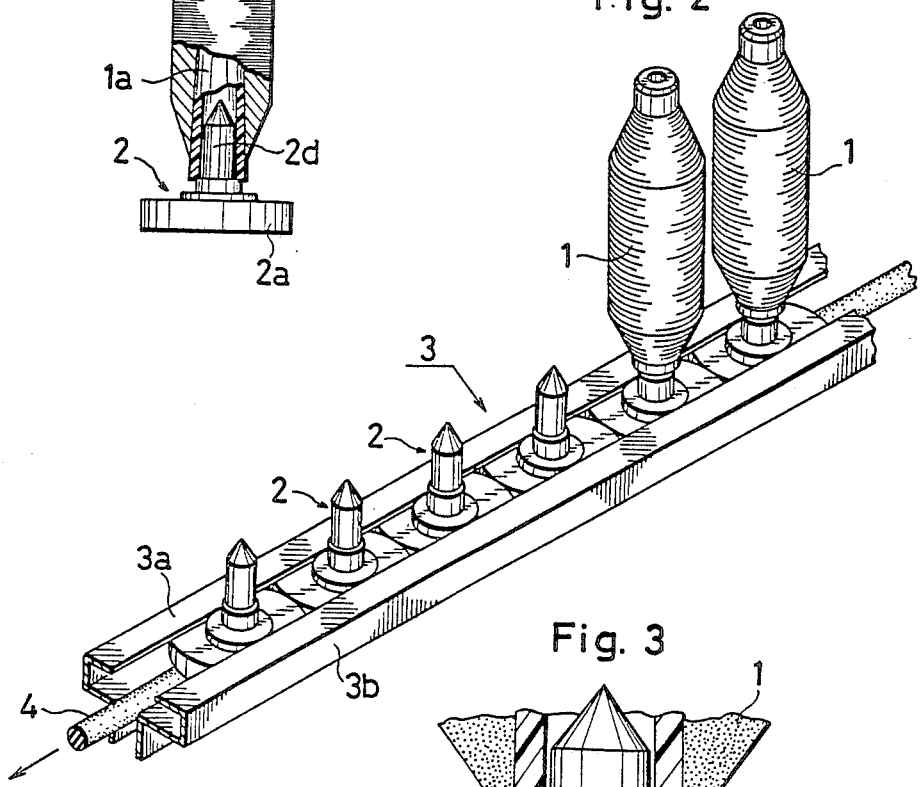
FIG. 2 is a perspective view showing a bobbin feeding device.
Figure 3:
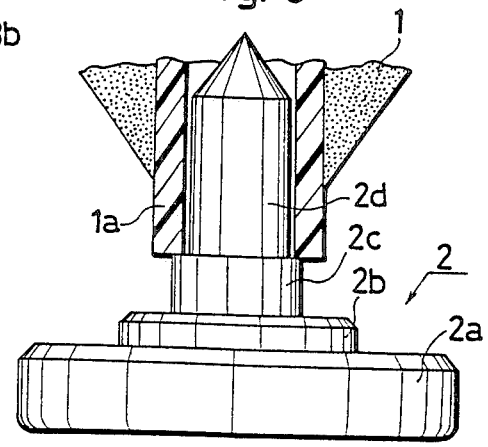
FIG. 3 is a front view on a larger scale showing the tray of FIG. 1.
Figure 5:
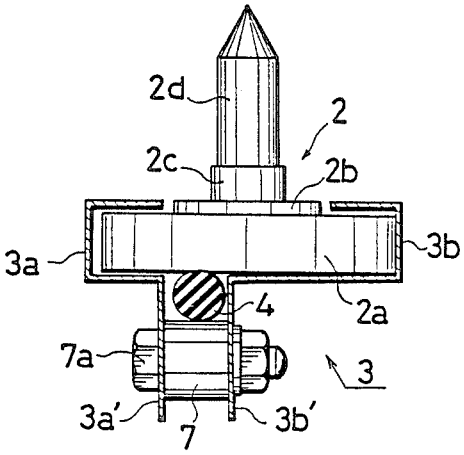
FIG. 5 is a cross-sectional view through the bobbin feeding device, particularly showing the relationship between the tray and the feeding device.

In FIG. 2 the trays 2 are mounted on a bobbin feeding device 3, which is substantially made up of a pair of guide rails 3*a* and 3*b* each having a U-shape cross-section. As shown in FIG. 5 the seat 2*a* is placed in the two rails 3*a*, 3*b* in its free state. The rails 3*a*, 3*b* are provided with extended portions 3a' and 3b', between which a shaft 7a is provided so as to secure a space between the rails 3a and 3b. The shaft 7a rotatably carries a roller 7. As best shown in FIG. 5 the seat 2a of the tray is placed in the space between the abutting rails 3a and 3b such that the supporting areas are different for the rail 3a and the rail 3b. The reference numeral 4 denotes a round belt running on the roller 7, wherein, as shown in FIG. 5, the belt 4 is kept in contact with the seat 2a at a point biased toward the smaller supporting area. It will be noted from FIG. 5 that the top peripheral surface of the belt 4 projects slightly above the inside bottom surfaces of both rails 3a and 3b, which means that the seat 2a (and accordingly, the tray as a whole) is biased toward the rail 3b. Preferably, the belt 4 keeps contact with the seat 2a at a point biased by one-third of the diameter thereof toward the rail 3a. In this situation, when the belt 4 is driven, the trays 2 follow the movement of the belt 4 under friction. The bosses 2b of the trays 2 slightly project in a space between the two rails 3a and 3b. So long as no obstacle acts on the trays, they continue to move in accordance with movement of the belt 4. But if any stopping means acts on the tray 2, it is stopped from following the movement of the belt 4, which continues to run. As a result, the subsequent bobbin 1 comes near the arrested bobbin 1, and finally the two bobbins stand side by side as shown in FIG. 2.

Figure 4:
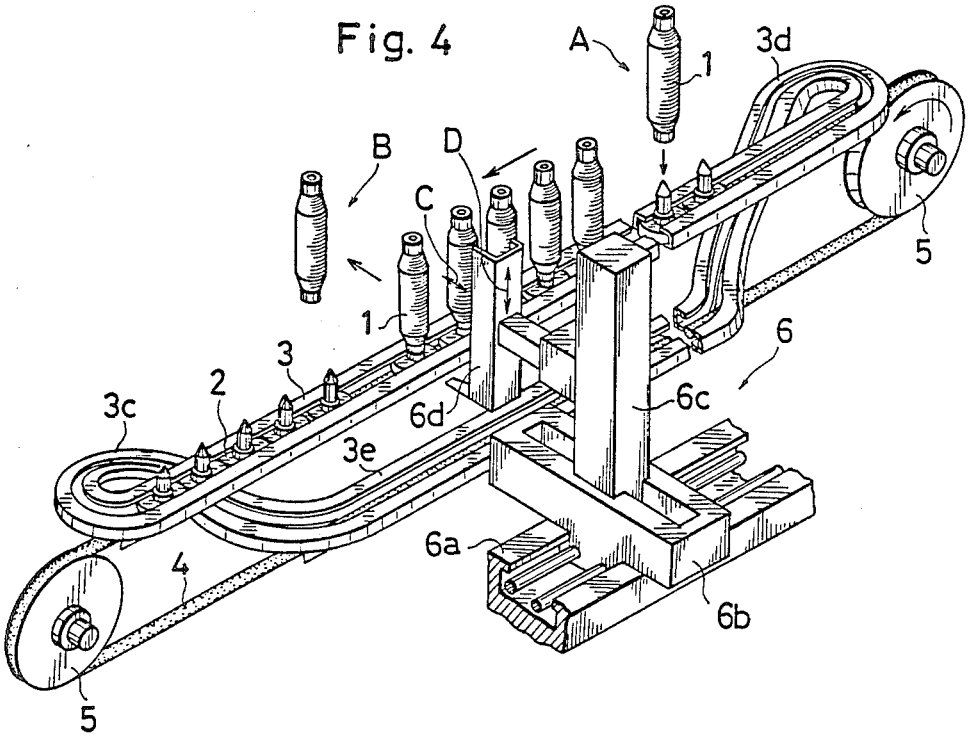
FIG. 4 is a perspective view showing a bobbin conveying apparatus embodying the present invention.

FIG. 4 shows an overall view of the bobbin feeding device 3 in operation with the bobbins 1 mounted thereon. The device 3 includes an upper side on which the bobbins 1 are placed, and a lower side 3e along which bobbin-free trays 2 are returned. The upper side and the lower side are connected by a first and a second slopes, wherein the first slope will be referred to as a down-path 3c, and the second slope will be as an up-path 3d. The endless belt 4 runs on a pair of pulleys 5 so that the belt 4 runs along both upper side and lower side of the feeding device 3 in the manner as described with respect to FIG. 5. One of the pulleys 5 is driven by an electric motor (not shown). The belt 4 is caused tp run in the direction of arrow in FIG. 4. On the down-path 3c the trays 2 alone are conveyed by the running belt 4. When the slope of the up-path 3d is slight, the trays can be pushed up by the subsequent tray moving up along the lower side 3e of the feeding device. However, when the slope is abrupt, a suitable hoist or chain will be needed to force up the tray along the up-path 3d. When the bobbin is to be mounted on the feeding device 3, it is placed thereon at the place (A) in FIG. 4. To effect this, the tray is stopped. When the bobbin is placed on the tray, the total weight of the bobbin acts on the tray, thereby enabling the tray to come into closer contact with the belt 4. The friction therebetween increases sufficiently for the bobbin-carrying tray to run in accordance with the movement of the belt 4. The bobbins in conveyance are spaced from each other because of the interlocation of the seats of the trays. The running speed of the belt can be adjusted as desired.

There is provided a bobbin take-up unit at the terminating end of the feeding device 3, where the bobbins are individually taken up from the respective trays 2. In the illustrated embodiment the unit is indicated by the reference numeral 6.

Figure 11:
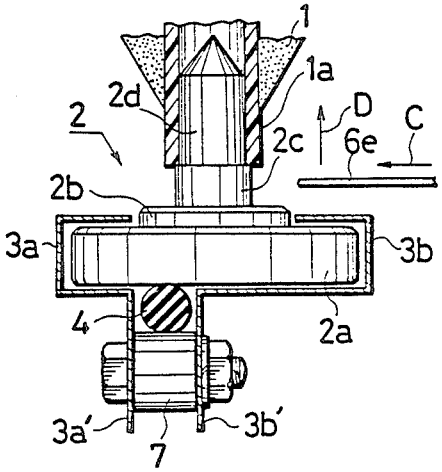
FIG. 11 is a view exemplifying a bobbin taking-up operation.
Figure 12:
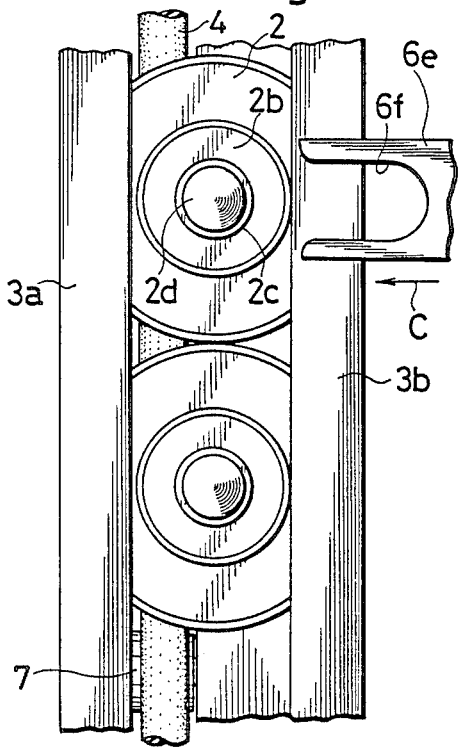
FIG. 12 is a plan view showing the state shown in FIG. 11.

The take-up unit 6 includes a rail 6a provided in parallel with the bobbin feeding side of the device 3, a slider 6b slidable along the rail 6a in the known manner, and a tower member 6c slidable to and from the feeding device 3, the tower member 6c having a take-up arm 6d vertically movable. The take-up arm 6d is provided with a pawl 6e shown in FIGS. 11 and 12 at its lower end. The pawl 6e includes a U-shaped recess 6f, which has a smaller width than the outside diameter of the bobbin body 1a. The take-up arm 6d is enabled to advance in the direction of arrow (C) toward the feeding device 3 until the pawl 6e comes into enagement with the collar 2c.

To take up the bobbin, the procedure is as follows: When the bobbin to be taken up arrives at the position indicated by the reference numeral (B), the tray is stopped by means of a stopper (not shown). At this moment the take-up arm 6d is advanced until the pawl 6d comes into engagement with the collar 2c, and then the arm is raised up in the direction of arrow (D), thereby extracting the bobbin from the tray. The extracted bobbin is released from the take-up arm 6d, and delivered to a predetermined place. To release the bobbin, a suitable means is used; for example, by tilting the take-up arm 6d, or by providing an extra swinging plate.

Figure 7:
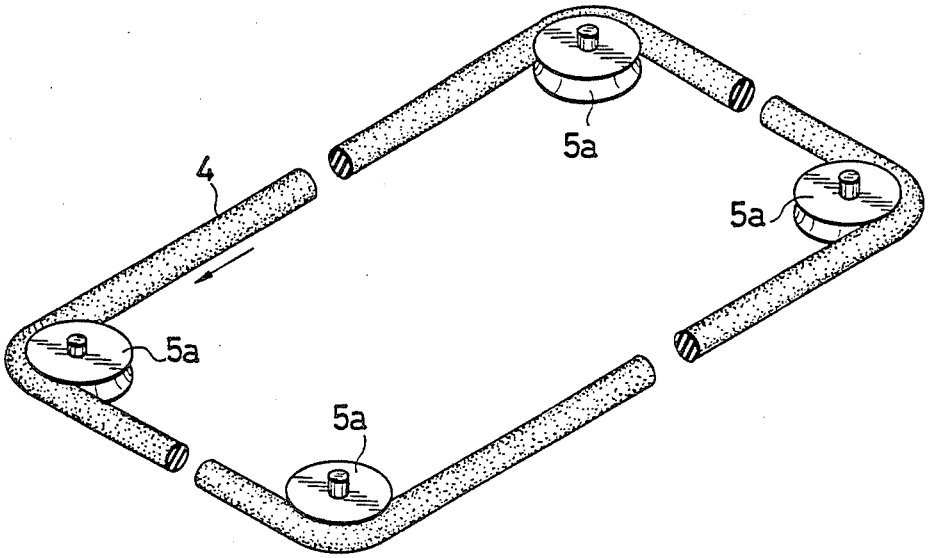
FIGS. 7 and 8 are schematic views exemplifying the structure of the arrangement of the belt and pulleys.
Figure 8:
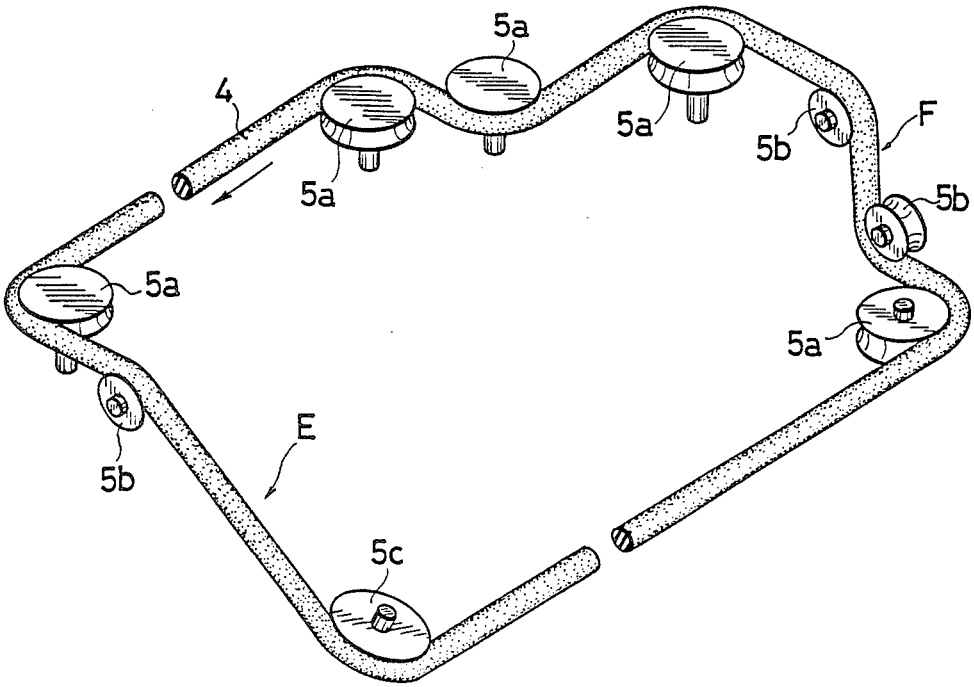
Figure 9:
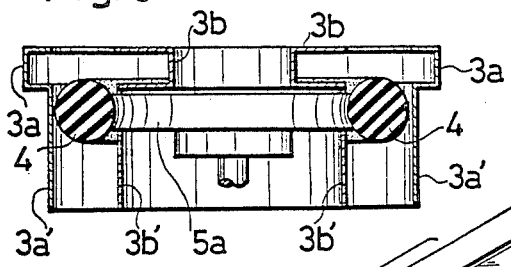
FIG. 9 is a partially cross-sectional view showing an end portion of the bobbin feeding device.

FIG. 4 shows a straight line of feeding device 3, but when the site is restricted, it have to be bent or curved horizontally or vertically. According to the present invention the bending or curving can be made with ease, because of the readily assemblable structure consisting of rails, a belt and pulleys. The assembling method is shown in FIGS. 7 and 8. In FIG. 7 the feeding device 3 is horizontally assembled. One of the sides is made a bobbin feeing side, and the opposite side is a bobbin-free trays return side. The rails are provided along all the sides, and one of the pulleys 5a is connected to a motor.

Figure 6:
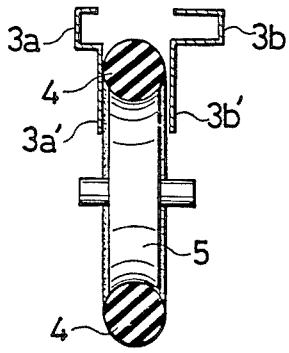
FIG. 6 is a partially cross-sectional view showing the bobbin conveying device.
Figure 10:
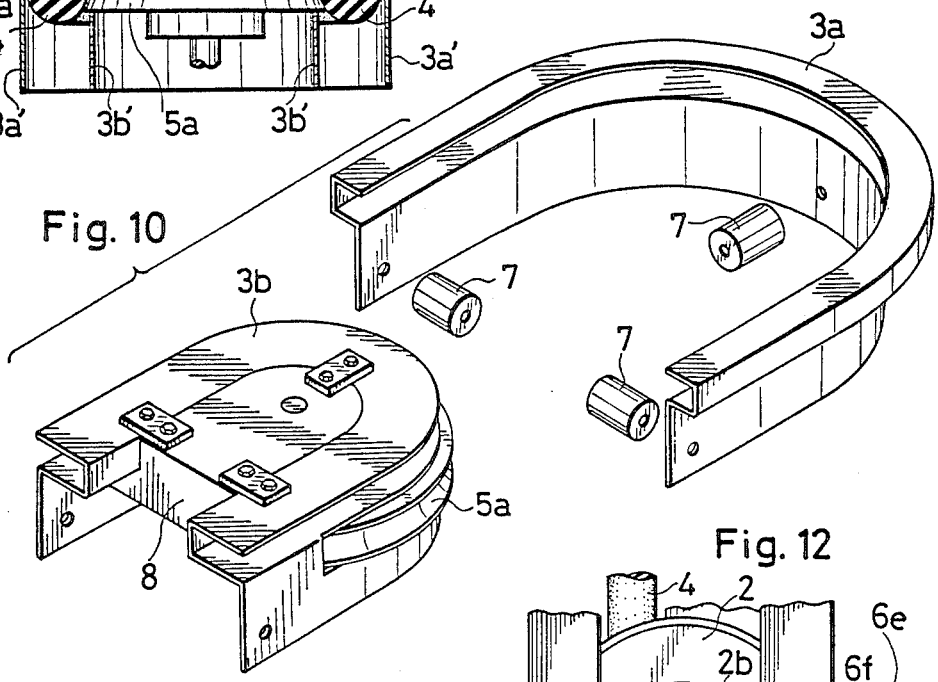
FIG. 10 is a perspective view showing the end portion shown in FIG. 9.

In FIG. 8 the feeding device 3 is constructed in an up-and-down state, and one of the pulleys 5a is connected to a motor. In addition to the pulleys 5a guide pulleys 5b and 5c are provided so as to ensure that the belt 4 runs up and down; that is, the pulleys 5b are intended to provide a down-path (F), and the pulley 5c is intended to provide an up-path (E). As shown in FIG. 6, the effective width of each pulley 5a, 5b or 5c is slightly smaller than the diameter of the round belt 4, and the lower part of the tray is utilized as guides for the pulleys 5a and 5c. FIG. 10 shows how the rails 3a and 3b are curved, and how they are assembled. The reference numeral 3b denotes an inner curved rail, which includes a pulley 5a at its top portion and a bearing block 8. The unit of the curved rails 3a and 3b is added to each arramgement shown in FIGS. 7 and 8.

Figure 13:
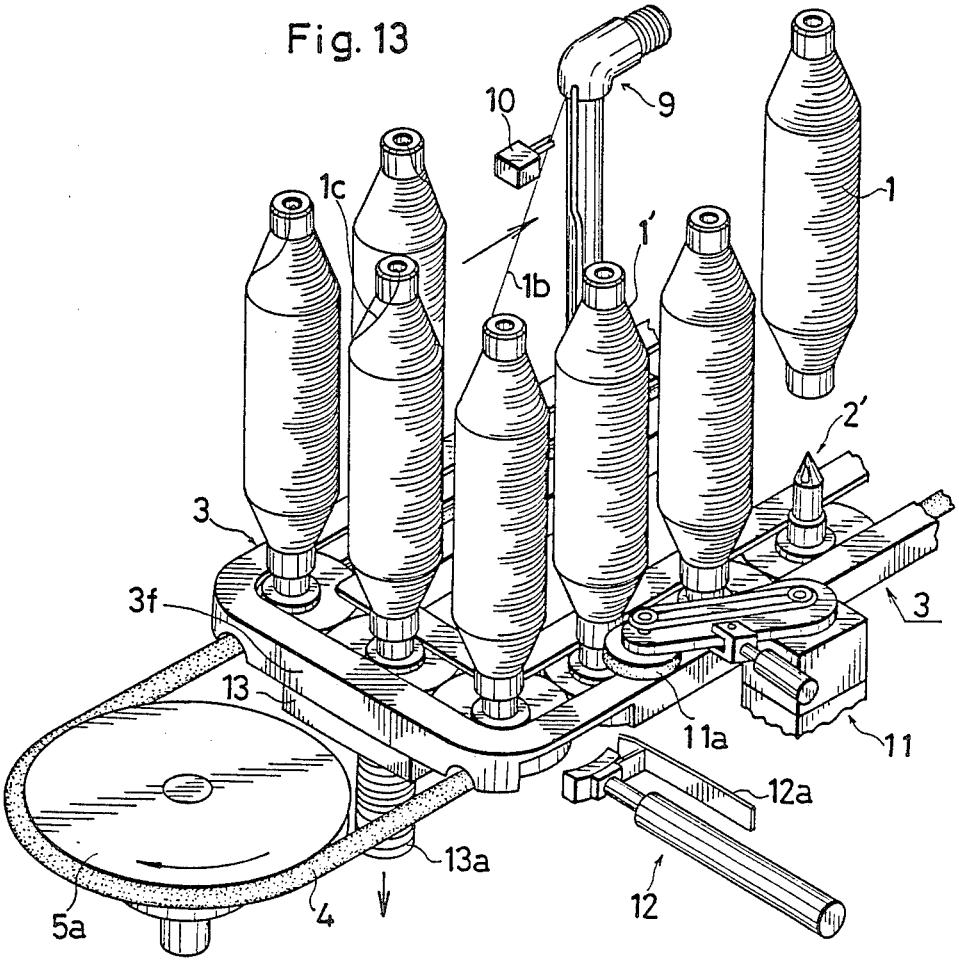
FIG. 13 is a perspective view showing a yarn-end treating device.

There is a demand for picking up a yarn end from the bobbin, and affixing to the top end therefo for facilitating an operation in the subsequent line. Under the present invention such a yarn-end treating device can be readily provided in the feeding device 3. FIG. 13 shows an example of such devices.

In FIG. 13 the rail 3 is provided with a bypass 3f, which is free from the round belt 4. The trays located in the bypass 3f are forced to the other side by means of a pusher 12, wherein the reference numeral 12a denotes a stopper whereby the subsequent bobbin is prevented from entering the bypass 3f while the preceding bobbin is pushed into the depth of the bypass 13f. The reference numeral 9 denotes a yarn-end sucker communicating with an air suction device (not shown). The sucker 9 is located in opposition to the bobbin 1' arrested at the predetermined position. The bobbin 1' is rotated by means of a rotating device 11, which includes a rotor 11a mounted on the top end of a swinging arm. The rotor 11a is rotated, and when it comes into contact with the bobbin 1', the bobbin 1' is put into rotation. While the bobbin 1' is in rotation, the yarn end 1*b* is sucked by the sucking device 9, and is cut by a cutter 10. When the bobbin 1' is forced into the bypass 13*f* by the pusher 12, the cut yarn end is sucked into the bore of the bobbin body 1*a* under suction provided by a second sucker 13 located underneath the feeding device 3. The reference numeral 13*a* denotes a sucking hose. To this end there is provided another type of tray 2', which is provided with a recess 14*b* having a fairly large diameter in the bottom of the seat 2*a*, and the boss 2*b*, the collar 2*c* and the pin 2*d* are provided with an air path 14, which is open in the recess 14*b*. On top of the pin 2*d* the air path 14 is open at 14*a*. In the illustrated embodiment the air path 14 is a single, but there can be two paths in parallel or three paths arranged in a triangular form. The opening can take the form of a groove along the conical surface of the top of the pin 2*d*.

Figure 14:
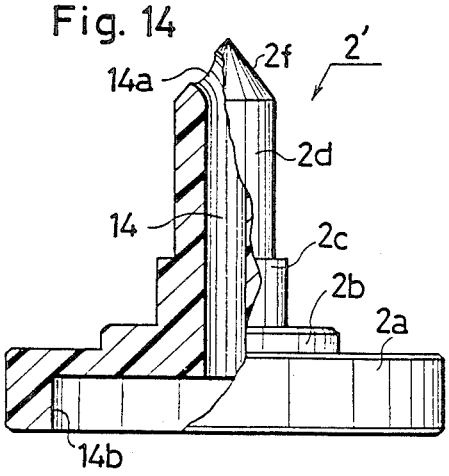
FIG. 14 is a partially cross-sectional view showing a modified version of the tray.
Figure 15:
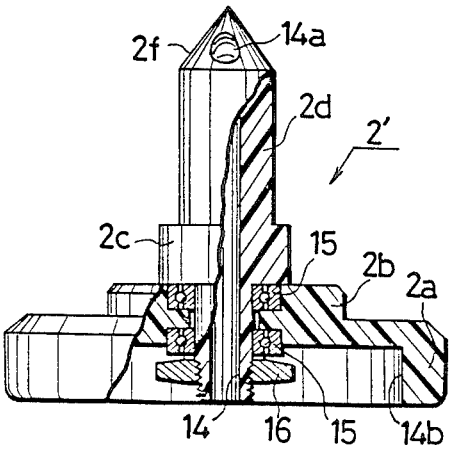
FIG. 15 is a partially cross-sectional view showing a further modified version of the tray.

FIG. 15 shows a rotary tray 2' having the air path 14. This tray 2' is additionally provided with bearings 15, on which the tray 2' can rotate. When necessary, the rotary tray can be used in the feeding device having no yarn-end treating device. Alternatively, the tray shown in FIG. 14 can be made rotative by using the rotor 11*a* for it.

According to the present invention, the bobbin feeding device can be assembled not only horizontally but also vertically. If desired, the feeding device can be assembled in an up-and-down form. Another advantage is that the trays are moved by the belt under friction, which allows them to become arrested without stopping the movement of the belt. Furthermore, no complicated driving means is needed, thereby resulting in a reduced production cost.

What is claimed is:

1. A bobbin conveying apparatus, which comprises:

a plurality of trays each having a bobbin supporting pin insertable in the bobbins;

first and second parallel guide rails for guiding and supporting said trays and which are assembled in loops for guiding the trays wherein an area of support of said first rail differs from that of said second rail;

a round belt running along said first and second guide rails, said belt contacting the bottom surfaces of the trays so that said trays are frictionally moved in accordance with movement of the belt and such that said trays are biased towards said second rail; and bobbin take-up means for taking up an arrested bobbin from the tray.

2. A bobbin conveying apparatus as defined in claim 1, wherein the tray comprises a seat and a boss having a larger diameter than the outside diameter of the bobbin, and a collar having a smaller diameter than the outside diameter of the bobbin body, and wherein the bobbin supporting pin is coaxial of the seat, the boss and the collar.

3. A bobbin conveying apparatus as defined in claims 1 or 2, wherein the first and second guide rails comprise a pair of steel bars having a C-shaped cross-section, inner spaces of said steel bars being joined so as to provide a path for receiving seats of the trays so that the trays are slidable along the guide rails, and wherein the round belt is slidable supported on rollers carried between the steel bars.

4. A bobbin conveying apparatus as defined in claim 2, wherein the seat of each tray is provided with a recess in its bottom, and wherein each bobbin supporting pin is provided with an air path being open not only in the recess but also on top of the bobbin supporting pin.

5. A bobbin conveying apparatus as defined in claims 2 or 4, wherein the collar and the bobbin supporting pin are rotatively supported on the seat of the tray.

* * * * *